US008689760B1

(12) United States Patent
Pham

(10) Patent No.: US 8,689,760 B1
(45) Date of Patent: Apr. 8, 2014

(54) CONTROL VALVE

(75) Inventor: Anh Pham, Pepper Pike, OH (US)

(73) Assignee: Buescher Developments, LLC, Cleveland, OH (US)

( * ) Notice: Subject to any disclaimer, the term of this patent is extended or adjusted under 35 U.S.C. 154(b) by 0 days.

(21) Appl. No.: 13/600,861

(22) Filed: Aug. 31, 2012

(51) Int. Cl.
*F01L 3/00* (2006.01)

(52) U.S. Cl.
USPC ..... 123/188.2; 123/188.1

(58) Field of Classification Search
USPC ..... 123/188.2; 239/585.1
See application file for complete search history.

(56) References Cited

U.S. PATENT DOCUMENTS 5,862,995 A * 1/1999 Wu ..... 239/533.2
5,937,520 A * 8/1999 Earhart et al. ..... 29/890.13
6,089,470 A * 7/2000 Teerman et al. ..... 239/88
2007/0170287 A1 * 7/2007 Pham ..... 239/585.1

* cited by examiner

*Primary Examiner* — Lindsay Low
*Assistant Examiner* — Omar Morales
(74) *Attorney, Agent, or Firm* — Pearne & Gordon LLP

(57) ABSTRACT

A poppet valve for controlling fuel in an electronically actuated valve assembly for diesel engine fuel injection systems comprising along a common axis a stem with a cylindrical guide and a neck, and a circular head, the neck being smaller in cross section than the guide, and the head being larger than the guide, the head having a conical surface facing the guide, the conical surface having an annular primary sealing area and a receding surface area radially outward of the primary sealing area, the primary sealing area having an inside diameter less than a diameter of the guide, an outside diameter greater than the guide and oriented obtusely to the axis, the receding surface area merging with the primary sealing area at an outside diameter of the primary sealing area, the receding surface area being oriented more obtusely to the axis than the orientation of the primary sealing area.

6 Claims, 2 Drawing Sheets

CONTROL VALVE

BACKGROUND OF THE INVENTION

The invention relates to improvements in electronic control valves for diesel fuel injection.

PRIOR ART

Contemporary diesel engines are built with electronically operated fuel injection control valves. These valves afford more precise control over fuel injection than traditional mechanical fuel injection systems. Electronic control offers both improved fuel economy and reduced air pollution.

Diesel injection electronic control valves typically employ a poppet style valve operated by a solenoid. The valve seat and valve head are subject to wear by fuel flow and by repeated contact during rapid opening and closing cycles. The force available to hold the valve closed is limited, being that developed by a relatively small solenoid in opposition to a return spring force that opens the valve. Consequently, the contact pressure across the contact area between the seat and valve head is limited and an increase in this area through eventual wear can result in a decrease in the contact pressure. The reduced contact pressure can, in turn, lead to leakage and, consequently, loss of precise control. U.S. Pat. No. 6,089,470 discloses a stepped valve head design intended to reduce the effects of long term wear in the valve seat area of a control valve. It appears, however, that the stepped head valve can increase cavitation and thereby lead to erosion of the valve sealing area and eventual loss of an adequate seal

SUMMARY OF THE INVENTION

The invention provides a novel poppet valve structure in an electronic control valve for diesel fuel injection. The disclosed valve sealing geometry can extend the service life of the valve by reducing contact area growth from wear and cavitation effects. Additionally, the valve is easier to manufacture with conventional methods than prior known valve designs proposed for extended service life.

The disclosed valve assembly has a dual angle poppet valve head that limits wear related growth of the seal contact area between the valve head and the associated valve seat. This feature avoids a reduction of the contact pressure at the valve seat thus maintaining a good seal over the service life of the valve. The dual angle avoids abrupt changes in the fuel flow path through the valve seating area thereby reducing cavitation which is known to cause surface erosion that can otherwise hasten failure of the valve seat. The dual angle valve head of the invention is relatively easy to produce with conventional grinding operations. One of the benefits of the ease of manufacture is that uniformity between parts is readily maintained. Such uniformity makes it easier to consistently and accurately achieve desired fuel control in a multi-cylinder engine.

DESCRIPTION OF THE PREFERRED EMBODIMENT

Figure 1:
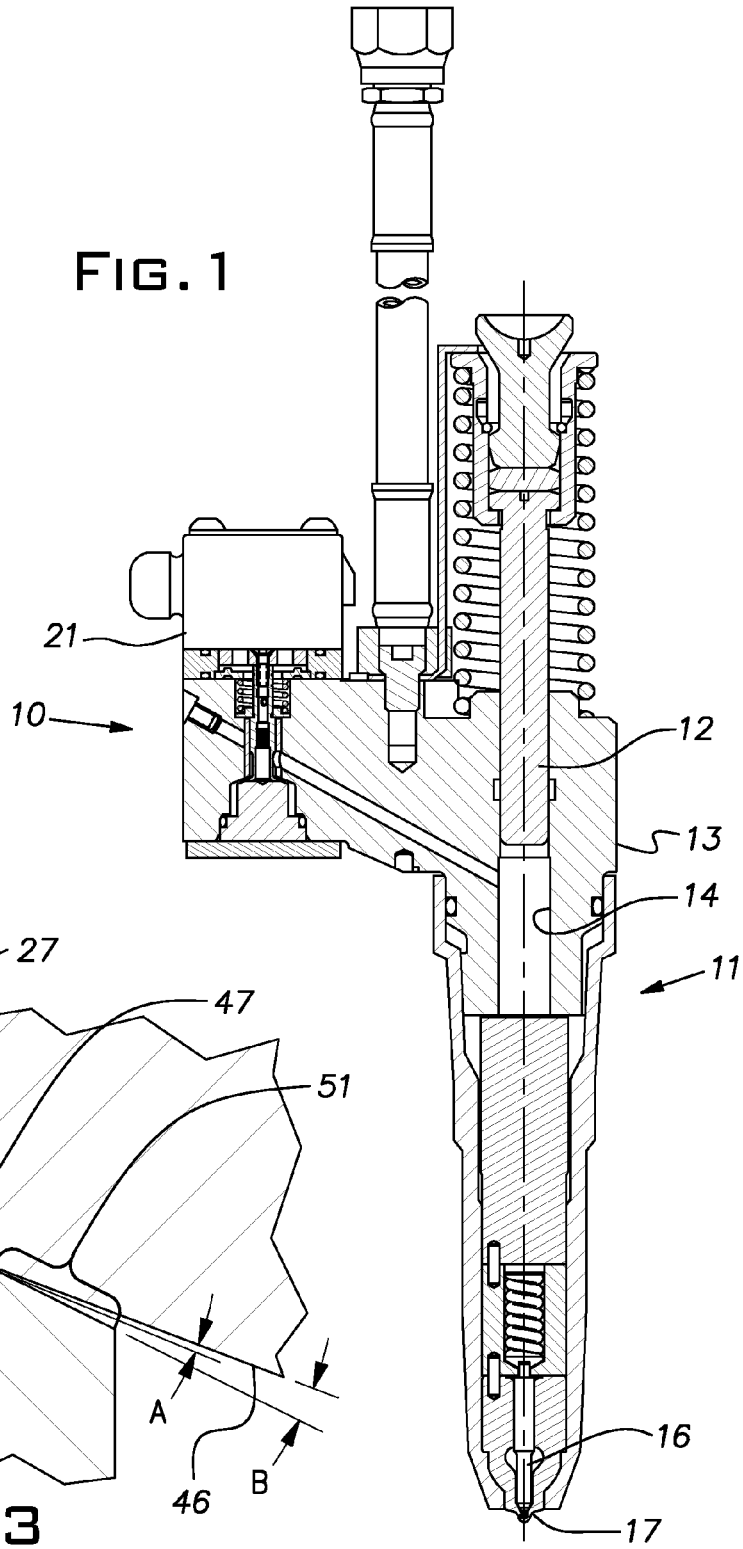
FIG. 1 is a cross-sectional view of an electronic unit injector.

A control valve 10 of the invention is shown in an electronic unit injector (EUI) 11 for a diesel engine. In a conventional manner, a plunger 12 within a body 13 of the injector 11 displaces fuel from a chamber 14. The control valve 10, when it is open, allows fuel to escape the chamber 14. When the valve 10 is closed, pressure builds in the chamber 14 until a needle 16 opens an injector nozzle 17 and fuel is injected into an engine cylinder.

The control valve 10 is operated electronically by energizing a solenoid 21 comprising a stator 22 and an armature 23. The control valve 10 is housed in the injector body 13. The control valve 10 has a guide bore 24 terminating at one end at a seat 26. In the illustrated arrangement, the bore 24 and seat 26 are provided by a cylindrical sleeve 27 pressed into a bore 28 in the body 13. Alternatively, one or both of the valve guide bore 24 and seat 26 can be provided by the body 13. A hollow poppet valve 31 has a stem 32 with a precision ground cylindrical guide 30 slidably mounted in the guide bore 24 for axial movement. The poppet valve 31 has, at one end, an annular head 33 for sealing the valve seat 26. Between the guide 30 and head 33 the stem 32 includes a reduced diameter neck 35. An end of the stem 32 distal from the head 33 is internally threaded to receive a screw 34 that fixes the poppet valve 31 to the armature 23. A compression spring 36, disposed in a counter bore 37, encircles the stem 32 and biases the poppet valve 31 to an open position where the head 33 is spaced from the seat 26. The spring 36 is maintained in a compressed state by a retainer plate 38. The spring 36 acts on the poppet valve 31 through an annular plate 39. A valve stop 41 limits movement of the poppet valve 31. The valve stop 41 is held in place by a retainer plate 42.

When a voltage is applied to the stator 22 by the electronic control module of the diesel engine, a magnetic field draws the armature 23 towards the stator. The magnetic force is sufficient to overcome the biasing force of the spring 36. The armature 23 pulls the poppet valve 31 against the seat 26 closing the valve 10. With the control valve 10 closed, the plunger 12 can develop hydraulic pressure in the fuel in the order of several thousand psi. To prevent leakage across the valve seat 26, the contact pressure between the valve head 33 and seat must be sufficient to create a seal. The closing force applied by the solenoid 21 is limited due to space restrictions, cycle times, and energy dissipation requirements. Since the closing force is limited, the contact area between the valve seat 26 and poppet head 33 must be relatively small to develop a high contact pressure. Wear between the surfaces has the potential of increasing the contact area and, consequently, reducing the contact pressure. A reduction in contact pressure can result in leakage across the valve seat 26 and degradation of the seat and poppet surfaces.

Figure 3:
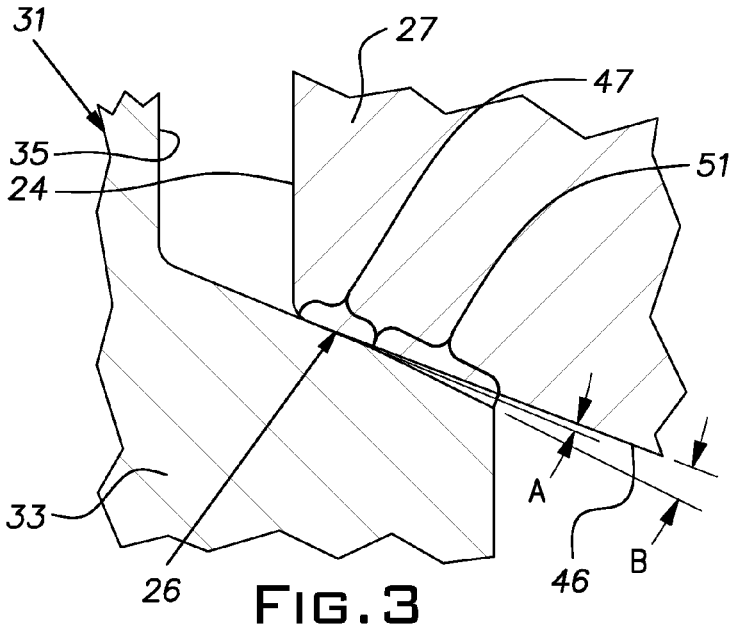
FIG. 3 is a fragmentary cross-sectional view, on a greatly enlarged scale, of a contact area of a poppet valve and seat of the control valve.
Figure 2:
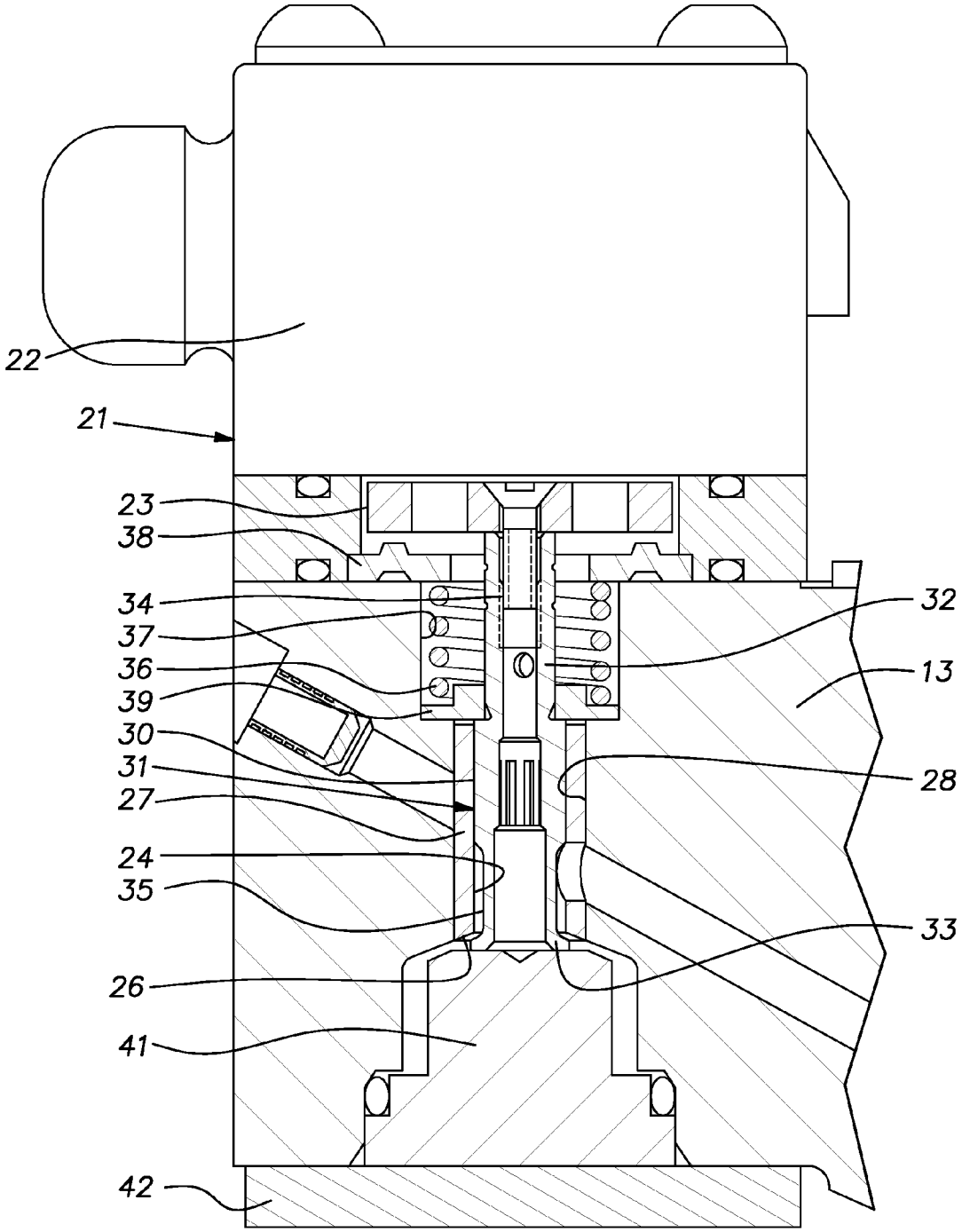
FIG. 2 is a cross-sectional view, on an enlarged scale, of a control valve of the invention.

The invention provides a poppet design that retards wear-related growth of the contact area with the seat and avoids high cavitation levels that can lead to degradation of the valve seating area. FIG. 3 illustrates the contact area of the valve seat 26 and poppet head 33 on a greatly enlarged scale when the valve is closed. By way of example, but not as a limitation, the outside diameter of the valve head can be about 0.300 inches. The valve seat 26 has a conical surface 46 defined by a straight line rotated about the axis of the guide bore 24. By way of example, this line can lie in an obtuse angle of 110 degrees from the axis of the bore 24. An annular primary sealing surface 47 on the poppet head 33 is conical, being described by a straight line rotated about the poppet valve axis. The line describing this primary sealing surface 47 lies at an obtuse "seat angle" from the poppet valve axis that is slightly more than the valve seat angle. For example, a seat differential angle "A" of the poppet head sealing surface 47 can be 1.5 degrees (at each side of the axis). Thus, the seat angle of the poppet valve head 33 is greater than the angle of the seat 26. The difference in the angle of the seat and valve head seat angle assures a positive contact between these surfaces. The width of an annular contact area, projected to a plane perpendicular to the common axis of the bore 24 and poppet valve 31 in the illustrated embodiment is nominally about 0.005 inch. The inner boundary of the contact area is the bore 24 which in the illustrated embodiment is nominally 0.276 inches.

The inventive sealing face of the poppet valve head 33 is formed with a contour that recedes from the seat angle of the primary sealing surface 47. The receding geometry, preferably, originates at about the radially outer margin of the primary sealing surface 47. The receding surface area, designated 51, in the illustrated construction, is a cone described by a straight line forming an "outer differential angle" "B" that is more obtuse than the seat angle of the primary surface area 47. By way of example, the receding surface area outer angle is about 4-1.2 to 6 degrees more obtuse than the seat angle of the primary sealing surface 47.

The receding surface 51 serves two important functions. As the contact areas of the seat 26 and poppet head 33 eventually wear, the outer angle geometry of the receding surface 51 reduces the potential for the contact area to grow. An increase in contact area, as mentioned, reduces the unit pressure the solenoid 21 can exert at closure of the valve 10; a loss of contact pressure can lead to leakage and eventual failure of the valve 10. The receding surface 51, by merging with the primary sealing surface 47 at a relatively shallow angle of say 5 degrees, reduces cavitation at and downstream of the sealing area 47. Cavitation at these areas can cause premature failure of the control valve 10. Additionally, the dual angle sealing surfaces 47, 51, when the poppet valve 31 is produced by conventional grinding techniques, can be simultaneously ground with a single, easily shaped grinding wheel. Stepped poppet valve designs such as shown in U.S. Pat. No. 6,089,470 can present problems since a stepped design can require a grinding wheel to be formed with an inside corner that with ordinary techniques is difficult to reliably produce. The accuracy with which the poppet valve 31 of the invention can be produced is conducive to the manufacture of control valves which have uniform performance characteristics, making it potentially easier to consistently achieve high fuel economy and reduced emissions. While the control valve 10 of the invention is described in connection with an electronic unit injector 11, it can be used with a pump supplying a remote injector.

It should be evident that this disclosure is by way of example and that various changes may be made by adding, modifying or eliminating details without departing from the fair scope of the teaching contained in this disclosure. For example, the profile of the receding surface 51 can be made with a convex shape, unlike that of the straight line profile of FIG. 3. Those familiar with the art will understand that the control valve 10 can be used in fuel injection pumps for diesel engines in which the injector is separate from the pump. The invention is therefore not limited to particular details of this disclosure except to the extent that the following claims are necessarily so limited.

What is claimed is:

1. A poppet valve for controlling fuel in an electromagnetically actuated valve assembly for a diesel engine fuel-injection system comprising, in coaxial relation, a stem with a cylindrical guide, and a circular neck, and a circular head, the stem and neck being smaller in cross-section than the guide and the head being larger in diameter than the guide, the head having a conical surface facing the guide, the conical surface consisting of a dual angle configuration with a seat angle surface having a seat angle surface extending from the circular neck and having a radius greater than a radius of the guide and an outer angle surface having radii larger than the radii of the seat angle surface and intersecting the seat angle surface, the seat angle surface being described by a first obtuse angle with respect to an axis of the poppet and the outer angle surface being described by an obtuse angle with respect to the axis that is larger than the first obtuse angle by less than 10 degrees.

2. The poppet valve as set forth in claim 1, wherein the angles differ by less than 5 degrees.

3. The poppet valve as set forth in claim 1, wherein the angles differ by about 4.5 degrees.

4. The poppet valve as set forth in claim 1, wherein the outer angle intersects the seat angle at a radial distance from the guide of about 0.005 inches.

5. A poppet valve for controlling fuel in an electronically actuated valve assembly for diesel engine fuel injection systems comprising along a common axis a stem with a cylindrical guide and a neck, and a circular head, the neck being smaller in cross section than the guide, and the head being larger in diameter than the guide, the head having a conical surface facing the guide, the conical surface having an annular primary sealing area and a receding surface area radially outward of the primary sealing area, the primary sealing area having an inside diameter less than a diameter of the guide, an outside diameter greater than the guide and being oriented obtusely to the axis, the receding surface area merging at an angle of six or less degrees with the primary sealing area at an outside diameter of the primary sealing area, the receding surface area being oriented more obtusely to the axis than the orientation of the primary sealing area.

6. A control valve for electronic diesel fuel injection comprising a valve body, a poppet valve, a stator and an armature, the valve body having a cylindrical bore and valve seat with a common axis adjacent an end of the bore, the poppet valve having a stem that includes a guide slidably disposed in the bore with an axis coincident with the bore axis, and a head capable of closing against the valve seat, the armature being fixed to the poppet valve whereby energization of the armature closes the valve head against the valve seat, the valve seat having a conical annular surface, the conical annular surface being oriented at an obtuse angle relative to the bore axis, the valve having a conical sealing area that consists of a primary sealing area and a secondary area radially outward of the primary area, the primary sealing area being oriented at an obtuse seat angle relative to the axis slightly greater than the angle of the conical annular surface of the valve seat, the secondary sealing area merging smoothly at an angle less than about 6 degrees with the primary sealing area and receding from the seat at a rate, relative to a radial measurement, greater than the rate at which the primary sealing area departs from the seat, the primary sealing area having an inside diameter smaller than the bore and an outside diameter larger than the bore.

* * * * *

UNITED STATES PATENT AND TRADEMARK OFFICE

CERTIFICATE OF CORRECTION

PATENT NO. : 8,689,760 B1
APPLICATION NO. : 13/600861
DATED : April 8, 2014
INVENTOR(S) : Anh Pham It is certified that error appears in the above-identified patent and that said Letters Patent is hereby corrected as shown below:

In the Claims:

Column 4, line 31 (claim 5, line 7), delete “having” and insert --consisting of--.

Signed and Sealed this
Seventeenth Day of June, 2014

Michelle K. Lee

Michelle K. Lee
*Deputy Director of the United States Patent and Trademark Office*